United States Patent [19]

Duval

[11] 4,451,180

[45] May 29, 1984

[54] METHOD FOR RESTRUCTURING RAILWAY ROADBEDS

[76] Inventor: Henry H. Duval, 3944 Boca Bay Dr., Dallas, Tex. 75234

[21] Appl. No.: 331,836

[22] Filed: Dec. 17, 1981

Related U.S. Application Data

[63] Continuation of Ser. No. 904,337, May 9, 1978, abandoned.

[51] Int. Cl.[3] ..... E02D 3/14

[52] U.S. Cl. ..... 405/269; 104/12; 238/2; 405/258; 405/266

[58] Field of Search ..... 405/266, 267, 668, 269, 405/258; 73/84; 104/12; 238/2

[56] References Cited

U.S. PATENT DOCUMENTS

| | | | |
|---|---|---|---|
| 2,229,912 | 1/1941 | Baily | 405/266 |
| 2,313,109 | 3/1943 | Wertz | 405/266 |
| 2,357,769 | 9/1944 | Rushmer | 405/269 |
| 2,440,921 | 5/1948 | Stephens | 405/269 |
| 3,130,552 | 4/1964 | Bodine | 405/266 |
| 3,397,542 | 8/1968 | Moulden | 405/266 |
| 3,408,819 | 11/1968 | Delfosse | 405/269 X |
| 3,608,318 | 9/1971 | Levy et al. | 405/269 X |
| 3,973,408 | 8/1976 | Paverman | 405/267 |
| 4,084,381 | 4/1978 | Cain et al. | 405/266 |

*Primary Examiner*—Dennis L. Taylor

*Attorney, Agent, or Firm*—Hubbard, Thurman, Turner & Tucker

[57] ABSTRACT

A method for restructuring a railway roadbed by injecting therein an amount of structural slurry effective to form a substantially continuous structured layer which provides increased load carrying capacity to said roadbed, which substantially blocks the intrusion of water into the subgrade soil through the ballast section of said roadbed, and which limits the upward intrusion of subgrade soil into the ballast section.

1 Claim, 9 Drawing Figures

METHOD FOR RESTRUCTURING RAILWAY ROADBEDS

This is a continuation of application Ser. No. 904,337, filed May 9, 1978, now abandoned Feb. 22, 1982.

BACKGROUND OF THE INVENTION

This invention relates to restructuring railway roadbeds. One aspect of the invention relates to the in-place restructuring of railway roadbeds without interruption to normal traffic. A further aspect of the invention relates to a novel method for restructuring railway roadbeds and correcting differential settlement or heaving problems therein by strengthening the roadbed structure, reducing its permeability to water, thereby increasing its stability and load-carrying capacity, and limiting the upward intrusion of subgrade soil into the ballast section.

Most of the mainline railway roadbeds in the United States are now an average of about 100 years old. Design criteria and construction methods used at the time these railway roadbeds were built are now proving inadequate when subjected to intensive loading resulting from the use of contemporary railroad equipment and operating procedures. The numerous recent train derailments which have been attributed to poor track conditions attest to this fact. These poor track conditions are largely due to an excessive accumulation of deferred track maintenance, together with the imposition of greater loading on railway roadbeds by larger equipment carrying heavier cargoes. Because of these poor track conditions, railroads are generally unable to operate at faster speeds which are economically desirable. Continued operation over these overloaded roadbeds and deteriorated track structures poses a substantial hazard to the safety and well-being of cargoes, equipment, personnel, and the general public as well.

Particularly, the break-down, differential settlement, and heaving which have been brought about by overloading the subgrade soils in railway roadbeds pose significant problems with respect to the operation and maintenance of today's railroads. These problems are primarily the result of repeated excessive loading that exceeds the ability of the ballast section to spread the loads over the railroad subgrade, as well as the intrusion of water into the roadbed structure and the upward intrusion of subgrade soil into the ballast section, all of which combine to further diminsh the load-carrying capacity of the roadbed. Lack of structural support in the railway roadbed in turn leads to more rapid fatigue and deterioration of all the components of the track structure, including the rails, metal accessories, and crossties.

Those working in the industry have utilized various techniques in an effort to overcome these problems. Driving poles or cull ties vertically into the roadbed embankment at the end of each crosstie throughout sections of instability has long been known to improve stability. However, this method of railway roadbed treatment is generally limited to situations where the zones of instability range from between 6 to 20 feet in depth below the crown of the roadbed structure. Furthermore, the pole driving method is limited to rather short sections subject to imminent failure as opposed to general improvement of the load-carrying capability of sections of trackage ranging up to many miles in length.

Another method of railway roadbed stabilization that has been used is the pressure grouting method. The pressure grouting method involves the high pressure injection of a sand, flyash, and cement slurry into zones of instability in the roadbed structure. This method of stabilization is very slow, and requires extensive experience and skill on the part of the applicator. In the pressure grouting process, injection points are driven into the roadbed at longitudinal intervals of about ten feet by pneumatic hammers. High pressure pumps then inject the slurry into the roadbed. According to the usual mode of operation, pressure grouting is continued until the earthen structure of the roadbed is stressed by the high pressure injection of the slurry. The surface of the track must be kept under close surveillance at all times while the injection is being made because the high pressure can cause the track to "hump". If not caught immediately, the track can be humped out of grade sufficiently to create a derailment hazard. The internal resistance of the roadbed brought about by the high pressure injection is such that the passage of traffic over the tracks will not depress the hump. Maintenance crews must then be brought in to cut out a portion of the ballast beneath the hump, thereby restoring the track to its normal elevation. This method is ordinarily used for correcting localized problems and does not inject a structural layer to provide continuous load-carrying capacity or to limit subgrade soil from working up into the ballast section.

A method is therefore needed for restructuring, strengthening, and sealing railway roadbeds, enabling them to accommodate the large equipment, heavy loads, and high speeds desirable for contemporary railroad operations. Furthermore, an economical and effective method for in-place restructuring of railway roadbeds without interruption to normal traffic is also needed.

SUMMARY OF THE INVENTION

According to the present invention, a method is provided for restructuring, strengthening, stabilizing, and sealing railway roadbeds. According to a preferred embodiment of the invention, railway roadbeds are restructured by injecting therein a structural slurry capable of forming a structured layer within said roadbed which provides increased load-carrying capacity thereto, which substantially blocks the intrusion of water into the subgrade soil layer through the ballast section of said roadbed, and which limits the upward intrusion of subgrade soil into the ballast section. According to another embodiment of the invention, railway roadbeds are restructured by vibrating a zone within the roadbed so as to enlarge the interstices thereof, and injecting therein an amount of structural slurry effective to form a substantially continuous structured layer which provides increased load-carrying capacity to the roadbed. According to another embodiment of the invention, railway roadbeds are restructured by determining the subsurface soil conditions, thereby identifying a zone within the roadbed in need of restructuring, inserting injection means into the zone of said roadbed where restructuring is needed while applying a vibratory force to said injection means, enlarging the interstices within the zone to be restructured by varying the frequencies and amplitudes of the vibratory forces applied to said injection means, injecting into the enlarged interstices an amount of structural slurry effective to form a structured layer within said zone, thereafter withdrawing said injection means while adjusting the frequencies and amplitudes of the vibratory forces applied thereto so as to reduce the volume of any interstices remaining within the structured layer.

Through use of the novel method disclosed herein, railway roadbeds can be restructured so as to accommodate the increasingly heavy loads being imposed upon them and the high speeds needed for contemporary railroad operations. Furthermore, the subject method will permit the restructuring of railway roadbeds at a higher rate of linear production per working day than is presently achievable through the use of conventional methods of track stabilization.

BRIEF DESCIPTION OF THE DRAWINGS

The present invention is best understood by reference to the following drawings in which.

Although the railway roadbeds depicted in FIGS. 1 through 6 are shown as embankments or fills, it is understood that cuts, combined cuts and fills, and at-grade sections can all occur over a given segment of railway roadbed, and the subject invention is similarly applicable to each such configuration.

DETAILED DESCRIPTION OF THE INVENTION

Figure 1:
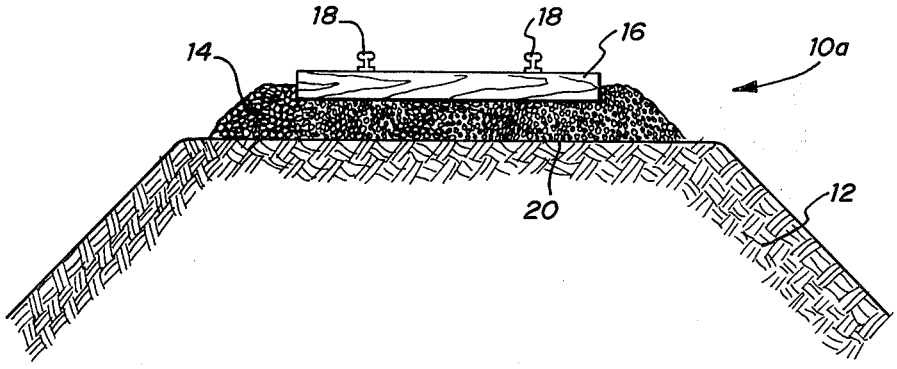
FIG. 1 depicts a sectional elevation view of a newly constructed railway roadbed.

Referring to FIG. 1, railway roadbed 10*a* typically comprises subgrade soil 12 having deposited thereon from about 4 to about 15 inches of ballast 14, which in turn supports crossties 16 to which steel rails 18 are affixed. Ballast 14 typically comprises a coarse and porous layer of rock or gravel. This porous layer is desirable in order that crosstie 16 can flex as rails 18 affixed thereto are loaded by the weight of passing trains and so that water can be channeled away from the track structure.

Figure 2:
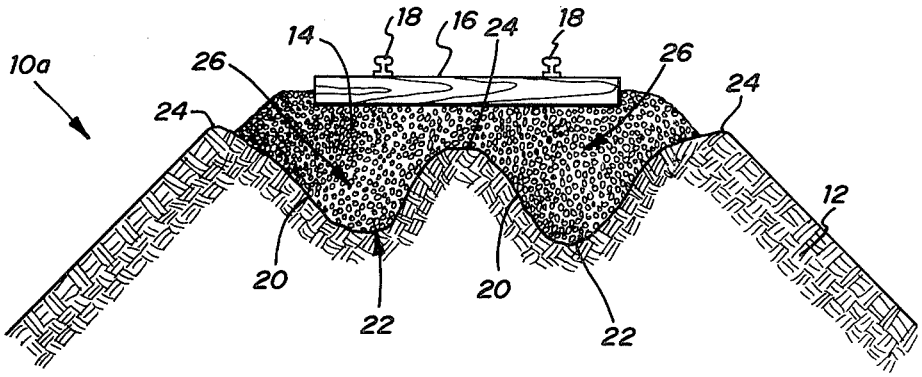
FIG. 2 depicts the railway roadbed of FIG. 1 after it has been subjected to ordinary use for a period of time during which differential settlement and heaving have occurred.

FIG. 2 depicts railway roadbed 10*a* of FIG. 1 after being subjected to oridnary use for a period of time. It is seen in FIG. 2 that subgrade solid 12 has heaved and settled differentially, so that ballast-subgrade interface 20 is generally lower at points 22 beneath rails 18 than at points 24 where subgrade soil 12 has been heaved upward by the stresses exerted thereon. This heaving and differential settling can lead to the formation of ballast pockets 26 between ballast-subgrade interface 20 and its original level as shown in FIG. 1.

Over a given length of railway roadbed, the physical composition, density, porosity, permeability, load-carrying capacity, and moisture content of subgrade soil 12 can vary considerably. In those sections of roadbed 10*a* where the layer of subgrade soil 12 is weaker, ballast pockets 26 tend to be deeper, meaning that the elevation of ballast-subgrade interface 20 at points 22 beneath rails 18 will vary as one proceeds longitudinally along railway roadbed 10*a*. Thus, it is seen that in the usual situation, heaving and differential settling can be expected to occur in a longitudinal as well as lateral direction through railway roadbed 10*a*. Heaving and differential settling cause disruptions to the track's surface and line, which can in turn lead to accelerated deterioration of track structure components, or otherwise create a derailment hazard. Additionally, as ballast pockets 26 begin to form, ballast 14 is fouled by subgrade soil 12 which works into the interstices thereof.

The subject invention provides a novel, rapid, efficient, and economical method for the in-place restructuring of overloaded railway roadbeds without interruption to normal rail traffic. According to the present invention, railway roadbeds 10*a* are restructured by injecting therein at low pressure an effective amount of a structural slurry. However, prior to injecting said slurry, it is preferable to first determine the subsurface soil conditions.

As used herein, the term "subsurface soil conditions" refers to any data or graphical representation thereof from which the physical composition, density, porosity, permeability, load-carrying capacity, moisture content, or other properties of the soil at any point within railway roadbed 10*a* can be ascertained. In the past, subsurface soil conditions have been determined by using augers to obtain soil samples at periodic intervals that were frequently too widely spaced to permit an accurate evaluation of the subsurface soil conditions between such points. According to the restructuring method of the present invention, the subsurface soil conditions are preferably evaluated on a continuous basis through the use of equipment that is capable of providing equivalent data in much less time. It is believed that means suitable for use in continuously determining the subsurface soil conditions are either presently available or can be readily made through the adaptation of existing technology. In particular, it is believed that seismic, resistivity, nuclear, or electromagnetic wave technology can be successfully employed for diagnosing or determining the internal condition of railway roadbed 10*a* and the position of ballast-subgrade interface 20 as shown in FIG. 2. By studying the subsurface soil conditions for each section of track, it is possible to identify with greater precision those zones where restructuring is needed, as well as the specifications for such restructuring. For purposes of the present invention, the subsurface soil conditions can either be determined immediately prior to restructuring a particular section of track, or somewhat in advance thereof since significant changes in the subsurface soil conditions will not normally occur over a reasonably short intervening period.

Figure 3:
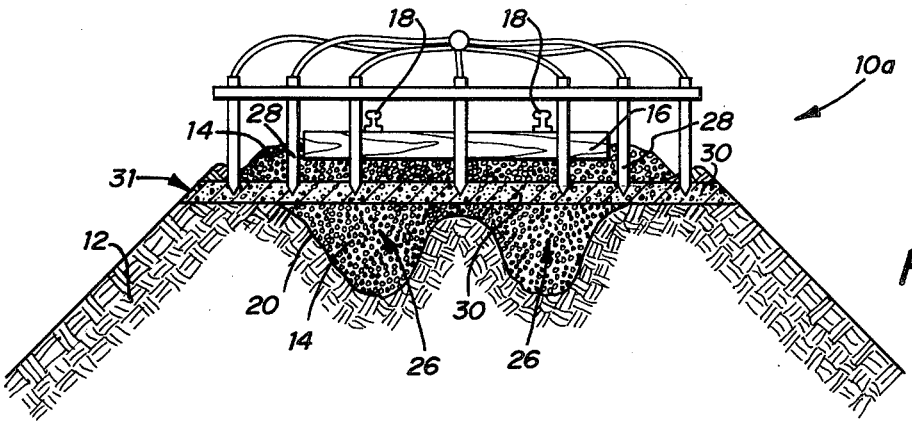
FIG. 3 depicts the railway roadbed of FIG. 2 where an injection means has been inserted and a structural slurry has been injected to form a structured layer according to the method of the invention.

FIG. 3 depicts railway roadbed 10*a* of FIG. 2 wherein injectors 28 have been inserted and structural slurry 30 has been injected therein to form structured layer 31. Once the subsurface soil conditions have been determined for a specific section of track, conventional soil mechanics computations can be utilized to determine the strength and thickness of the structured layer 31 required to distribute the concentrated loads imposed by trains passing over rails 18. The thickness of structured layer 31 will vary according to the subsurface soil conditions within railway roadbed 10*a*, the design loads that will be imposed upon rails 18, and the specific composition of structural slurry 30. In some cases, it may be desirable to obtain representative samples from ballast 14 and subgrade soil 12 to aid in determining the strength and thickness requirement of structured layer 31. In most situations, it is believed that the thickness required for structured layer 31 will range from about 4 to about 36 inches, and preferably about 8 inches.

According to a preferred embodiment of the invention, injectors 28 are inserted into railway roadbed 10*a* by the combined application of hydraulic, pneumatic, and vibratory forces. Although hydraulic and/or pneumatic forces have previously been used for inserting injectors in the pressure grouting method of roadbed stabilization, the effectiveness of those conventional insertion techniques can be significantly enhanced by applying them in combination with a vibratory means. It is well known that different types of soils vibrate according to different harmonic patterns. Thus, by adjusting the frequency and/or amplitude of a vibratory force applied to a soil mass, it is possible to vary the size of the interstices between the soil particles. For purposes of the present invention, insertion of injectors 28 is facilitated by adjusting the vibratory frequencies and/or amplitudes thereof so as to maximize the size of the interstices within the roadbed. Because subsurface soil conditions will differ at different points throughout railway roadbed 10*a*, the vibratory force applied to each of injectors 28 is preferably independently adjustable so as to maximize the interstitial volume of subgrade soil 12 and ballast 14 around each of injectors 28. Differing soil conditions can easily be compensated for by means of vibrators which can either be manually or automatically controlled so as to adjust the frequencies and/or amplitudes of injectors 28 as they penetrate railway roadbed 10*a*. The vibratory frequency required to enlarge the interstices of subgrade soil 12 and ballast 14 will typically range from about 400 to 3000 vibrations per minute. Preferably, the number and spacing of injectors 28 will be such that once they are inserted to the desired depth, the entire soil mass in the zone to be restructured at that time can be vibrated simultaneously.

Where ballast 14 is severely fouled, it may be necessary to mechanically agitate the ballast section prior to inserting injectors 28 therein. This mechanical agitation can be accomplished, for example, by means of a paddle type agitator employed between successive crossties 16, or by a device capable of removing ballast 14 from beneath short sections of track, breaking it up, and then replacing it as before.

By vibrating injectors 28 so as to enlarge the interstitial volume of subgrade soil 12 and ballast 14, the pressure required to inject structural slurry 30 into ballast 14 can be significantly reduced. Whereas pressures utilized in the pressure grouting method can range up to about 450 psi, the injection pressure required for the present invention will ordinarily range from about 15 to about 75 psi, and preferably from about 30 to about 45 psi (gauge pressures).

Figure 4:
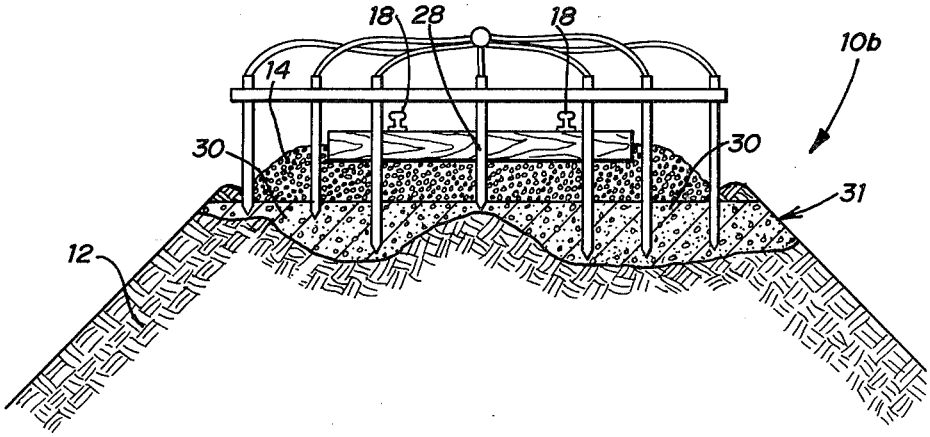
FIG. 4 depicts a sectional elevation view of a railway roadbed wherein the thickness of the structured layer has been varied to compensate for varying subsurface soil conditions occurring across the width of the roadbed.
Figure 5:
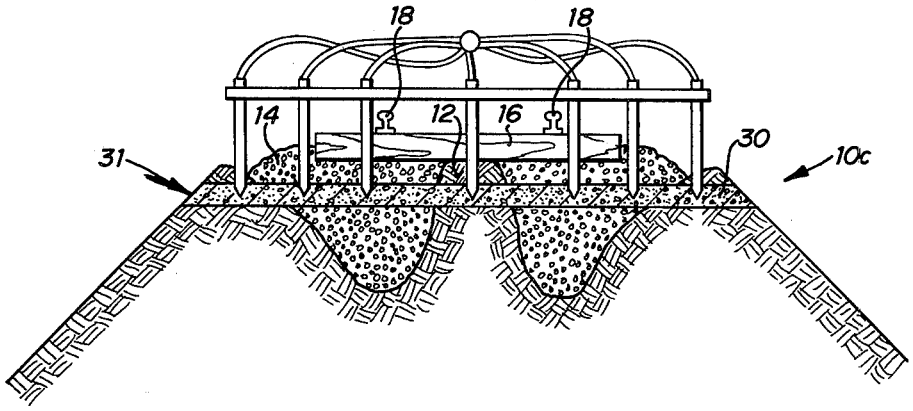
FIG. 5 depicts a sectional elevation view of a restructured railway roadbed wherein the structured layer traverses subgrade soil which has intruded upward through the ballast section of the roadbed at the center of the track structure.

Once injectors 28 have been positioned at an appropriate depth within railway roadbed 10*a* as determined from the subsurface soil conditions, structural slurry 30 is injected therein so as to form structured layer 31 having the desired placement, thickness, and load-carrying capacity. In a preferred embodiment, vibration of injectors 28 is continued during injection of structural slurry 30 to aid in dispersing it throughout the zone to be restructured. A network of sensing devices can be utilized for controlling the depth and thickness of application of structural slurry 30. According to a preferred embodiment of the invention, a computer can be utilized to determine the subsurface soil conditions from input data supplied by external sensors, after which it automatically positions injectors 28, individually adjusts their vibratory frequency and amplitude, and meters through each of them the appropriate amount of structural slurry 30. Referring to FIG. 4, the bottom of structured layer 31 will vary according to the subsurface soil conditions across railway roadbed 10b, and the specifications necessary to restructure it to a desired load-carrying capacity.

Where subgrade soil 12 has intruded ballast 14 to the extent that crosstie 16 is center-bound between rails 18 of railway roadbed 10*c* as shown in FIG. 5, that portion of subgrade soil 12 remaining beneath crosstie 16 and above structured layer 31 should preferably be removed after restructuring according to the method of the invention. This can be accomplished by scraping the upper surface of restructured layer 31 and reinserting ballast 14 in place thereof as a part of regular track maintenance procedures. Furthermore, referring to FIGS. 1 through 5, there will preferably always be at least about 4, and most preferably, from about 8 to about 12 inches of ballast 14 between the bottom of crosstie 16 and the top of structured layer 31.

Structural slurry 30 comprises a combination of materials that can satisfactorily be pumped into the interstices within subgrade soil 12 and ballast 14 in the zone to be restructured to form a structural layer that, when "set", hydrated, or hardened, will attain sufficient strength to protect the underlying portions of the railway roadbed 10*a*, 10*b*, 10*c* from further breakdown due to overloading, and at the same time seal off the roadbed so as to prevent further damage or weakening therein due to the intrusion of water through the ballast section. Structural slurry 30 preferably comprises materials selected from sand, flyash, cement plant stackdust, portland cement, retarding agents, water, and the like. The viscosity of structural slurry 30 is controlled so as to permit easy dispersion throughout the interstices in subgrade soil 12 and ballast 14, preferably with aid from the vibratory action of injectors 28. While the materials set forth above are the preferred primary ingredients of structural slurry 30, it is also within the scope of the invention to incorporate other additives, fillers, or ingredients therewith for the purpose of varying the viscosity, strength, setting or hydration time, sealing characteristics, or other properties thereof. Many such materials are known throughout the cement and soil stabilization arts, and their use as components in structural slurry 30 is considered to be within the scope of the present invention. It is further understood that the relative amounts of various component materials in structural slurry 30 can also vary depending upon other significant factors such as required strength, soil conditions, climatic conditions, economic considerations, and the like.

Preferred compositions for use as structural slurry 30 of the invention can include from about 30 to about 80% sand, from about 10 to about 50% flyash, from about 5 to about 20% cement plant stackdust, from about 5 to about 20% portland cement, from about 0.1 to about 5% of a retarding agent, all percentages by weight, together with sufficient water to permit the desired flow characteristics. A particularly preferred composition for use as structural slurry 30 of the invention comprises 50% sand, 30% flyash, 11.5% cement plant stackdust, 8% portland cement, 0.5% of a retarding agent, all percentages by weight, and sufficient water to permit the desired flow characteristics. Sand utilized as a component of structure slurry 30 is preferably fine or silt-like since coarser sand does not flow as well.

While the cementitious composition described above is a preferred structural slurry 30 for use with the subject invention, other compositions can also be used. For example, flyash can be mixed with aerated molten sulfur, liquid asphalt, or mixtures thereof, to produce a structural slurry 30 that is also within the scope of the invention. Where asphalt is used alone, however, the resulting strength of structured layer 31 will generally not be as great as when structural slurry 30 comprises cement or aerated molten sulfur.

After structural slurry 30 is in place, injectors 28 are withdrawn. During withdrawal, the vibratory frequencies and amplitudes of injectors 28 are preferably varied again so as to reduce the volume of any interstices remaining within structured layer 31. In this instance, as before, the vibratory frequency required to reduce the interstitial volume can vary from about 400 to about 3000 vibrations per minute, depending upon the particular makeup of subgrade soil 12 and ballast 14. Reducing the interstitial volume in this manner will result in increased strength in structured layer 31 after structural slurry 30 has hardened or set.

Unconfined compressive strengths of structured layer 31 achievable through use of the method disclosed herein typically range up to about 200 psi or more for structural slurries 30 comprising about 10% by weight of cement, as compared to about 40 psi for a normal railway roadbed such as that shown in FIG. 1. While the strength of structured layer 31 will be greater where the section of track being restructured is not subject to ordinary rail traffic until hydration or hardening, as the case may be, has taken place, satisfactory results can be achieved by merely slowing traffic to a speed such as from about 5 to about 20 miles per hour, for example, after injection of structural slurry 30, until such time as structural slurry 30 has set, hydrated, or hardened sufficiently to prevent significant impairment of the strength thereof. It is believed that the period of time required could range from about 2 hours to about a week, depending upon the soil and slurry compositions, thickness of structured layer 31, climatic conditions, and the like. In this manner it is possible to effectively reduce vibrations which might otherwise significantly impair the ultimate strength of structured layer 31 without substantially disrupting normal traffic.

Figure 6:
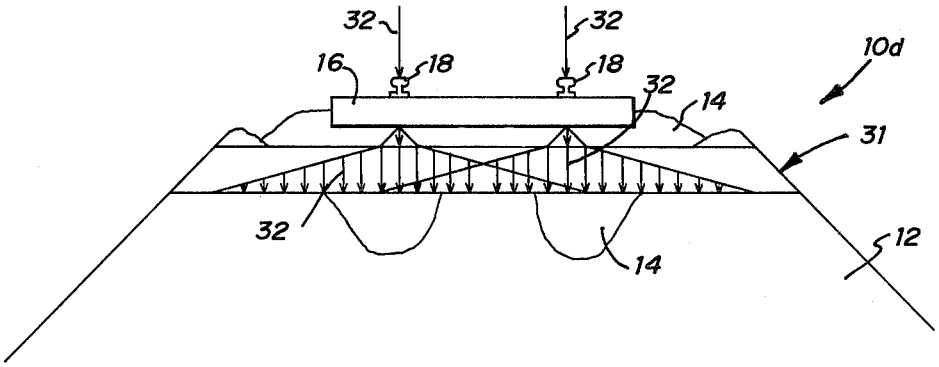
FIG. 6 is a simplified elevation view of a restructured railway roadbed depicting the general manner in which forces applied downward through the rails of the track structure are distributed through the ballast section and across the structured layer of said railway roadbed.

Arrows 32 of FIG. 6 depict the manner in which loads imposed on rails 18 are distributed downward through ballast 14 to structured layer 31, and are further distributed across structured layer 31 and imparted to the underlying section of railway roadbed **10*d*. Structured layer 31 should have sufficient thickness, strength, and width to adequately distribute the static and dynamic loads transmitted to it through the track structure so as not to exceed the load-bearing capacity of that portion of railway roadbed 10*d* beneath structured layer 31**.

Once structural slurry 30 has hydrated or hardened, structured layer 31 of railway roadbed **10*d* is substantially impervious to water. Therefore, water entering the roadbed structure through ballast 14 is diverted by this impervious zone and prevented from entering subgrade soil 12 beneath structured layer 31, thereby substantially improving the overall stability of the roadbed. It should also be noted, especially when dealing with railway roadbed embankments, that water can enter subgrade soil 12** below the restructured zone through the outer slope of the embankment. However, while not completely excluding the entrance of water into the earthen structure, the subject method does substantially diminish the intrusion of water and thereby adds to the stability and loadbearing capacity of the roadbed.

In addition to preventing the intrusion of water from above, structured layer 31 also limits the upward migration of subgrade soil 12 into ballast 14. Where the railway roadbed has not been restructured, as shown in FIG. 2, the forces associated with the passage of rail traffic cause subgrade soil 12 to heave upward, fouling ballast 14, increasing the stress exerted on the center of crosstie 16, and otherwise limiting the useful properties of the ballast section of the track structure. By limiting this upward soil migration, as shown in FIG. 5, additional significant gains in the construction and maintenance for railway roadbeds can be realized. For example, it is widely recognized throughout the industry that fouling significantly reduces the useful life of the ballast section, and concurrently accelerates the wear and tear on all other track structure components. Thus, when fouling is controlled by a structured layer 31 emplaced according to the subject method, it will not be necessary to add, clean, or replace ballast 14 as frequently, and the life of all other elements of the track structure will similarly be extended.

In this respect, it is noted that for some time persons working in the railroad industry have sought to use prestressed concrete crossties. The relative economics of the larger wood crossties and the concrete crossties have now become acceptably close, permitting increased use of the concrete ties. However, the economics of the concrete crossties require a desired spacing of about 26 inches as compared to about 19 inches to 21 inches for wood crossties. The use of the concrete crossties, which have a useful longevity roughly twice that of the wood crossties, is being forestalled because the wider spacing increases and intensifies the loads imposed upon the already overloaded railway roadbeds. The restructuring process disclosed herein imparts more than an adequate load-carrying capacity to permit railroads to adopt the use of the concrete crosstie and high density, heavy tonnage trackage, thereby lowering all costs of track and roadbed maintenance, together with operating costs. Collaterally, this process makes possible further technological advances in railroad operations, for example, larger and more cost-efficient rolling stock and increased operating speeds. The subject process can provide railway roadbeds with sufficient load-carrying capacity to accommodate any reasonably foreseeable technological advances in railroad equipment and operations.

Figure 7:
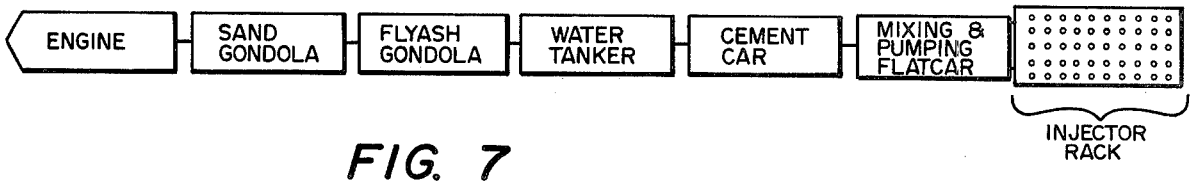
FIG. 7 depicts a block diagram of an equipment train suitable for performing the method of the subject invention.

In a preferred embodiment, the method of the present invention is effectuated on a commercial scale by means of a work train comprising elements such as those shown in FIG. 7. FIG. 7 is a block diagram depicting a work train comprising an engine, sand gondola, flyash gondola, water tanker, cement car, mixing and pumping flatcar, and an injector rack. The elements shown in FIG. 7 are only illustrative of an embodiment suitable for practicing the invention, and neither the type nor number of elements enumerated therein should be construed as limiting the scope of the invention. For example, dry ingredients could be premixed in an off-track batch plant, transported in gondolas, and then mixed with water at the use site.

Figure 8:
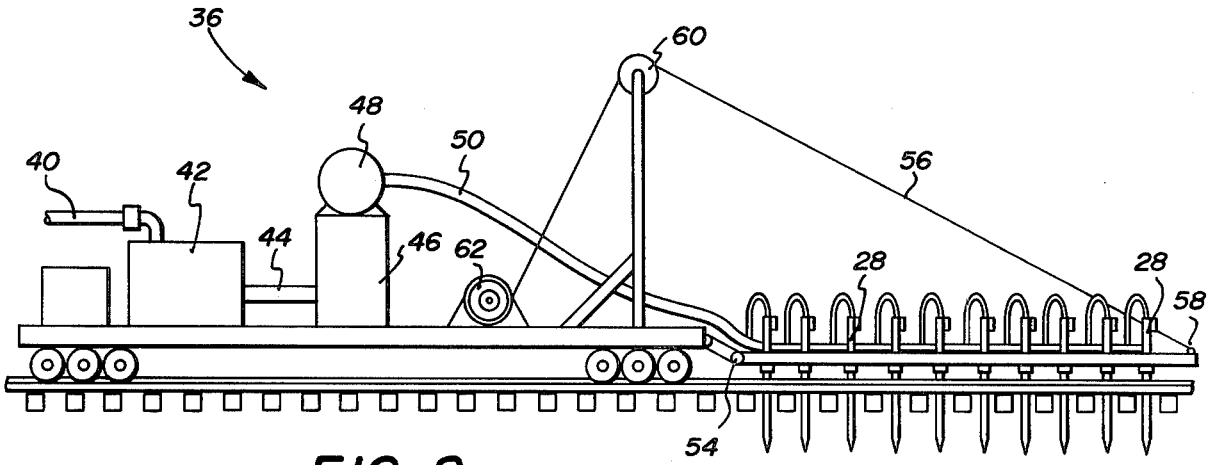
FIG. 8 depicts a simplified elevation view of the mixing and pumping flatcar shown in the block diagram of FIG. 7.
Figure 9:
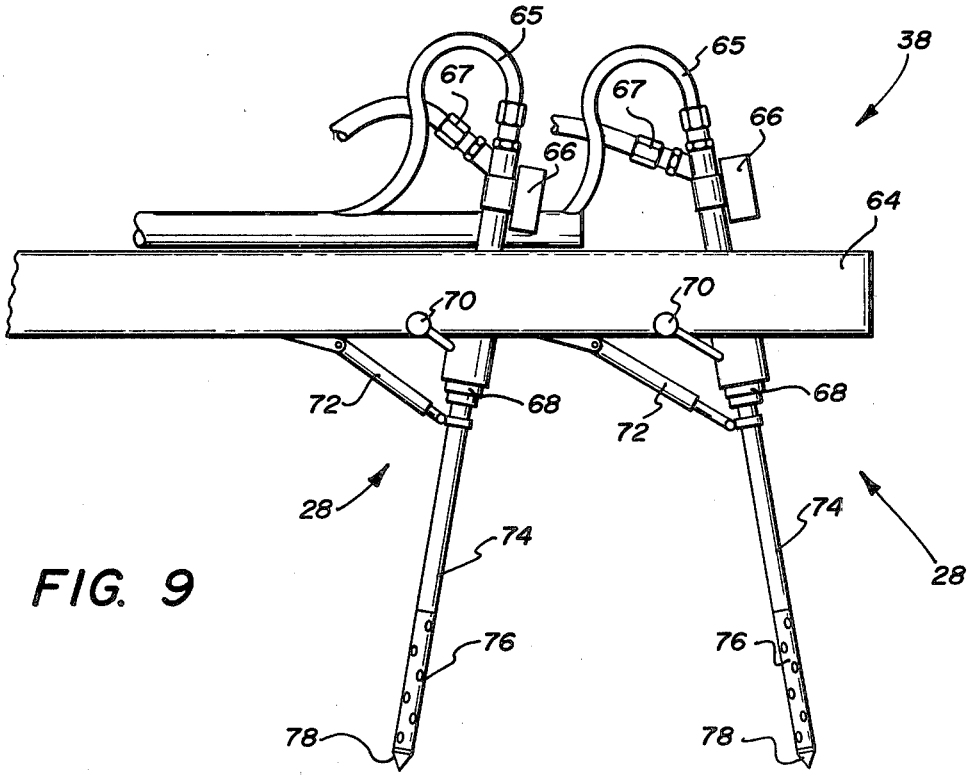
FIG. 9 depicts a simplified elevation view of two of the injection means utilized for injecting the structural slurry into the railway roadbed as shown in FIGS. 3 through 5.

A simplified elevation view of mixing and pumping flatcar 36 with injector rack 38 attached thereto is shown in FIG. 8. The dry components of structural slurry 30 are transported to mixing and pumping flatcar 36 by means of material feed line 40 which discharges into premix pugmill 42. After premixing in premix pugmill 42, the dry components are transported by means of feed auger 44 into pugmill mixer 46, where water, a retardant and other optional components are added. The slurry thereby formed is then forced by slurry pump 48 through slurry header 50 to injector 28 mounted on injector rack 38. Injector rack 38 is pivotally attached to mixing and pumping flatcar 36 by means of pivot bearing 54, and can be elevated and lowered by means of guy cables 56 extending from anchor point 58 over pulley 60 to winch 62. Referring to FIG. 9, injectors 28 mounted on injector support beam 64 of injector rack 38 further comprise slurry supply lines 65, variable frequency vibratory means 66, pneumatic supply line 67, hydraulic ram 68, hydraulic pump 70, angle ram 72, slurry injection heads 74, replaceable injection head 76, and replaceable injection tip 78. While the injector rack shown in FIG. 7 comprises five rows of injectors 28 with 10 injectors 28 in each row, it is understood that the number of injectors, as well as the pattern in which they are arranged, can be varied within the scope of the invention. As previously discussed, the angle and depth of insertion of injectors 28 is preferably computer controlled in such manner as to automatically compensate for variations in the subsurface soil conditions. The flow of structural slurry 30 through slurry header 50 to injectors 28 is controlled so as to automatically shut off the slurry feed to each injector 28 as the layer of structural slurry 30 reaches the desired thickness, as shown in FIGS. 3 through 5.

While the method and apparatus disclosed herein have been described in relation to a preferred embodiment thereof, it is understood that the method of the invention can be employed with other conventional railway maintenance techniques in an integrated program of railway roadbed maintenance. Thus, referring again to FIGS. 2 through 5, where crossties 16 have been worn to the point where replacement is required, or where ballast 14 has become severely fouled, it may be advantageous to simultaneously perform other steps or functions in addition to those enumerated with respect to the subject invention. For example, severly fouled ballast 14 can be removed from beneath segments of track, screened, and replaced thereunder prior to injecting structural slurry 30 according to the method of the invention. Alternatively, rather than injecting structural slurry 30 as described above, structured layer 31 of the present invention can also be made by raising rails 18 and crossties 16, removing the uppermost layer of ballast 14, thereafter removing a next lower layer of ballast 14 and/or subgrade soil 12 and admixing said ballast and/or subgrade soil with structural slurry 30 in another pugmill, redepositing said admixture on the railway roadbed to form structured layer 31, covering structured layer 31 with at least about 4 inches of ballast 14, and again lowering rails 18 and crossties 16 on to said roadbed.

Furthermore, although the apparatus suitable for effectuating the method of the invention has been described herein as embodied in a work train, it is understood that other embodiments will be similarly effective for different or specialized applications of the method. Thus, a truck-mounted apparatus would be equally effective for stabilizing sections of trackage at road crossings, turnouts, and the like.

Moreover, while the process and equipment described herein are primarily directed to the restructuring of railway roadbed embankments, it is apparent that the in-place restructured zone of the subject method can be beneficially applied in other applications as well, such as, for example, highways, airport runways, and levees, in which event considerable modification of the equipment configuration would be required. The equipment disclosed herein is designed to operate within the close confines of a railway roadbed whereas the operating strictures in other applications could be significantly fewer or different.

The substantially continuous structured layer produced according to the subject method protects the subgrade of a railway roadbed from overloading, substantially blocks the intrusion of water into the subgrade through the ballast section, and prevents the upward intrusion of subgrade soil into the ballast section. As will be apparent to those of ordinary skill in the art upon reading the present disclosure, many alterations, substitutions, and equivalents may be applicable to the various disclosed embodiments of the invention. It is the intent, however, that the concepts disclosed herein be limited only by the appended claims.

What is claimed is:

1. A method for restructuring a railway roadbed comprising the steps of:

(a) removing ballast from beneath the rails and crossties of said roadbed;

(b) admixing said ballast with a structural slurry;

(c) depositing said admixture beneath the rails and crossties of said roadbed to form a structured layer; and thereafter (d) providing at least about 4 inches of ballast between said structured layer and said crossties.

* * * * *

UNITED STATES PATENT AND TRADEMARK OFFICE

CERTIFICATE OF CORRECTION

PATENT NO. : 4,451,180

DATED : May 29, 1984

INVENTOR(S) : Henry H. Duval, Jr.

It is certified that error appears in the above-identified patent and that said Letters Patent is hereby corrected as shown below:

Column 3, line 15, "Desciption" should be --Description--.

Column 4, line 6, "solid" should be --soil--.

Signed and Sealed this

*Twentieth* Day of *August 1985*

[SEAL]

*Attest:*

DONALD J. QUIGG

*Attesting Officer*

*Acting Commissioner of Patents and Trademarks*